US006377778B1

(12) United States Patent
Kikuchi et al.

(10) Patent No.: US 6,377,778 B1
(45) Date of Patent: Apr. 23, 2002

(54) FIXING DEVICE USING INDUCTION HEATING

(75) Inventors: Kazuhiko Kikuchi, Yokohama; Tomohiro Matsunai, Kawasaki; Kenji Takano, Tokyo-To; Yasuhiro Ebata, Kawasaki, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/473,062

(22) Filed: Dec. 28, 1999

(51) Int. Cl.[7] ..... G03G 15/20

(52) U.S. Cl. ..... 399/330; 399/335; 219/416; 492/46

(58) Field of Search ..... 399/330–336; 219/216, 619, 671; 492/46

(56) References Cited

U.S. PATENT DOCUMENTS

| | | | | | |
|---|---|---|---|---|---|
| 5,713,069 | A | * | 1/1998 | Kato | 399/330 |
| 5,752,150 | A | | 5/1998 | Kato et al. | 399/330 |
| 5,819,150 | A | * | 10/1998 | Hayasaki et al. | 399/330 |
| 5,848,319 | A | * | 12/1998 | Morigami et al. | 399/22 |
| 5,881,349 | A | * | 3/1999 | Nanataki et al. | 399/328 |
| 5,970,299 | A | * | 10/1999 | Sano et al. | 399/330 |
| 6,026,273 | A | | 2/2000 | Kinouchi et al. | 399/328 |
| 6,031,215 | A | * | 2/2000 | Nanataki et al. | 219/619 |
| 6,035,174 | A | * | 3/2000 | Ito | 399/328 |
| 6,049,691 | A | * | 4/2000 | Abe et al. | 399/330 |
| 6,055,403 | A | * | 4/2000 | Watanabe | 399/328 |
| 6,069,347 | A | * | 5/2000 | Genji et al. | 219/619 |
| 6,137,985 | A | | 10/2000 | Kinouchi et al. | 399/329 |
| 6,154,629 | A | | 11/2000 | Kinouchi et al. | 399/329 |

FOREIGN PATENT DOCUMENTS

| | | |
|---|---|---|
| JP | 10-207270 | 8/1998 |

* cited by examiner

*Primary Examiner*—Fred L. Braun
(74) *Attorney, Agent, or Firm*—Foley & Lardner

(57) ABSTRACT

A device of this invention has a hollow heat roller (1), the surface of which has a coat of a metal layer, an excitation coil which is arranged in the heat roller (1) and generates a magnetic flux in the heat roller (1) to heat it by induction, and a press roller (2) which is in contact with the heat roller (1) under a predetermined pressure. The excitation coil has at least two maximal heating portions (42, 43) in the circumferential direction of the heat roller (1). The excitation coil is located to form one maximal heating portion (42) within the range of ±30° along the circumferential direction from the position of a nip (41) where the heat roller (1) contacts the press roller (2). With this structure, since heat accumulates in the heat roller (1) to keep it warm, the warm-up time can be shortened.

10 Claims, 8 Drawing Sheets

FIXING DEVICE USING INDUCTION HEATING

BACKGROUND OF THE INVENTION

The present invention relates to a fixing device that uses induction heating to fix an image on a print medium in an image forming apparatus such as an electrostatic copying machine, printer, or the like.

A fixing device used in an image forming apparatus fixes a developing agent such as toner on a print medium by melting a toner layer formed on the surface of the print medium by heating. A fixing device which is related to the present invention uses a halogen lamp or the like as a heating source. The lamp is arranged inside a heat roller to heat it. A press roller is pressed against the heat roller and rotated so as to bring the print medium into press contact with the heat roller, and a paper sheet is passed between the two rollers.

FIG. 26 shows a schematic structure of the overall fixing device. A halogen lamp 102 is arranged inside a thin, metal heat roller 101. An elastic member is formed on the surface of a press roller 103 to make the print medium in sufficient press contact with the heat roller 101. The heat roller 101 and press roller 103 are supported while being applied with a predetermined pressure by a compression mechanism (not shown). Furthermore, the heat roller 101 and press roller 103 are rotated by a drive source (not shown) in the directions of arrows at the same speed as the convey speed of the print medium.

In the fixing device using the halogen lamp 102, light and heat coming from the halogen lamp in the heat roller are radiated in all directions to heat the entire roller. For this reason, losses occur upon converting light into heat, and upon warming up air in the heat roller and conducting heat to the heat roller. Therefore, the overall heat conversion efficiency is as low as 60 to 70%, resulting in poor power economy. Also, a long warm-up time is required from when the power supply is turned on until the heat roller 101 reaches the temperature required for fixing operation.

SUMMARY OF THE INVENTION

It is, therefore, an object of the present invention to provide an induction heating fixing device which has high heat efficiency, can attain power savings, and can shorten the warm-up time from power ON until the beginning of fixing operation.

According to the present invention, there is provided an induction heating fixing device comprising a hollow heat roller, a surface of which has a coat of a metal layer, induction heating means, arranged in the heat roller, for generating a magnetic flux in the heat roller to heat the heat roller by induction, and a press roller which is in contact with the heat roller under a predetermined pressure, wherein the induction heating means has at least two maximal heating portions in a circumferential direction of the heat roller, and the induction heating means is located to form at least one of the maximal heating portions within a range of ±30° along the circumferential direction from a position of a nip where the heat roller contacts the press roller.

The device may further comprise a temperature sensor for detecting a temperature of the heat roller, and the temperature sensor may be located to fall within a range of ±30° along the circumferential direction from the position of at least one of the maximal heating portions.

The device may further comprise a release agent applying roller for applying a release agent onto an outer circumferential surface of the heat roller, the induction heating means may have at least one minimal heating portion in the circumferential direction of the heat roller, and the release agent applying roller may be located to fall within a range of ±30° along the circumferential direction from a position of the minimal heating portion.

An induction heating fixing device for an electrophotography apparatus of the present invention comprises a hollow heat roller, a surface of which has a coat of a metal layer, induction heating means, arranged in the heat roller, for generating a magnetic flux in the heat roller to heat the heat roller by induction, and a press roller which is in contact with the heat roller under a predetermined pressure, wherein the heat roller includes, as the metal layer, at least a first metal layer having first thermal conductivity, and a second metal layer having second thermal conductivity higher than the first thermal conductivity, and a thickness of the first metal layer in a radial direction of the heat roller is larger at end portions of the heat roller in a longitudinal direction than at a central portion in the longitudinal direction.

The thickness of the second metal layer in the radial direction of the heat roller may be constant from two end portions of the heat roller in the longitudinal direction to the central portion thereof in the longitudinal direction.

The thickness of the second metal layer in the radial direction of the heat roller may be larger at end portions of of the heat roller in the longitudinal direction than at the central portion thereof in the longitudinal direction.

A total thickness of the first and second metal layers in the radial direction of the heat roller may be constant over the longitudinal direction of the heat roller.

The device may further comprise a drive mechanism for rotating the heat roller, and the drive mechanism may drive the heat roller to vary a stop position with respect to the maximal heating portions of the induction heating means every time the heat roller is stopped.

An induction heating fixing device for an electrophotography apparatus of the present invention comprises a hollow heat roller, a surface of which has a coat of a metal layer, induction heating means, which is arranged in the heat roller and has an excitation coil, for generating a magnetic flux in the heat roller by supplying a current to the excitation coil to heat the heat roller by induction, and a press roller which is in contact with the heat roller under a predetermined pressure, wherein an insulating sheet is inserted between an inner surface of the heat roller and the excitation coil, and the insulating sheet has magnetic flux shielding portions for shielding the magnetic flux generated by the excitation coil for two end portion regions of the heat roller in a longitudinal direction.

The device may further comprise a rotation mechanism for rotating the excitation coil relative to the insulating sheet, and the rotation mechanism may rotate the excitation coil to locate the magnetic flux shielding portions in the vicinity of portions where a density of magnetic flux generated by the excitation coil has a first value, when a print medium having a first width undergoes a fixing process, and to locate the magnetic flux shielding portions in the vicinity of portions where the density of magnetic flux generated by the excitation coil has a second value higher than the first value, when a print medium having a second width smaller than the first width undergoes the fixing process.

In this case, when a temperature sensor is equipped, the temperature sensor is preferably located at a position which has aphase angle $\alpha$ with respect to aposition of one of maximal heating portions along the circumferential direction, and in which $\alpha$ is substantially equal to $\beta/2$ where $\beta$ is the maximum rotation angle of the excitation coil.

DESCRIPTION OF THE PREFERRED EMBODIMENTS

The preferred embodiments of the present invention will be described hereinafter with reference to the accompanying drawings.

Figure 27:
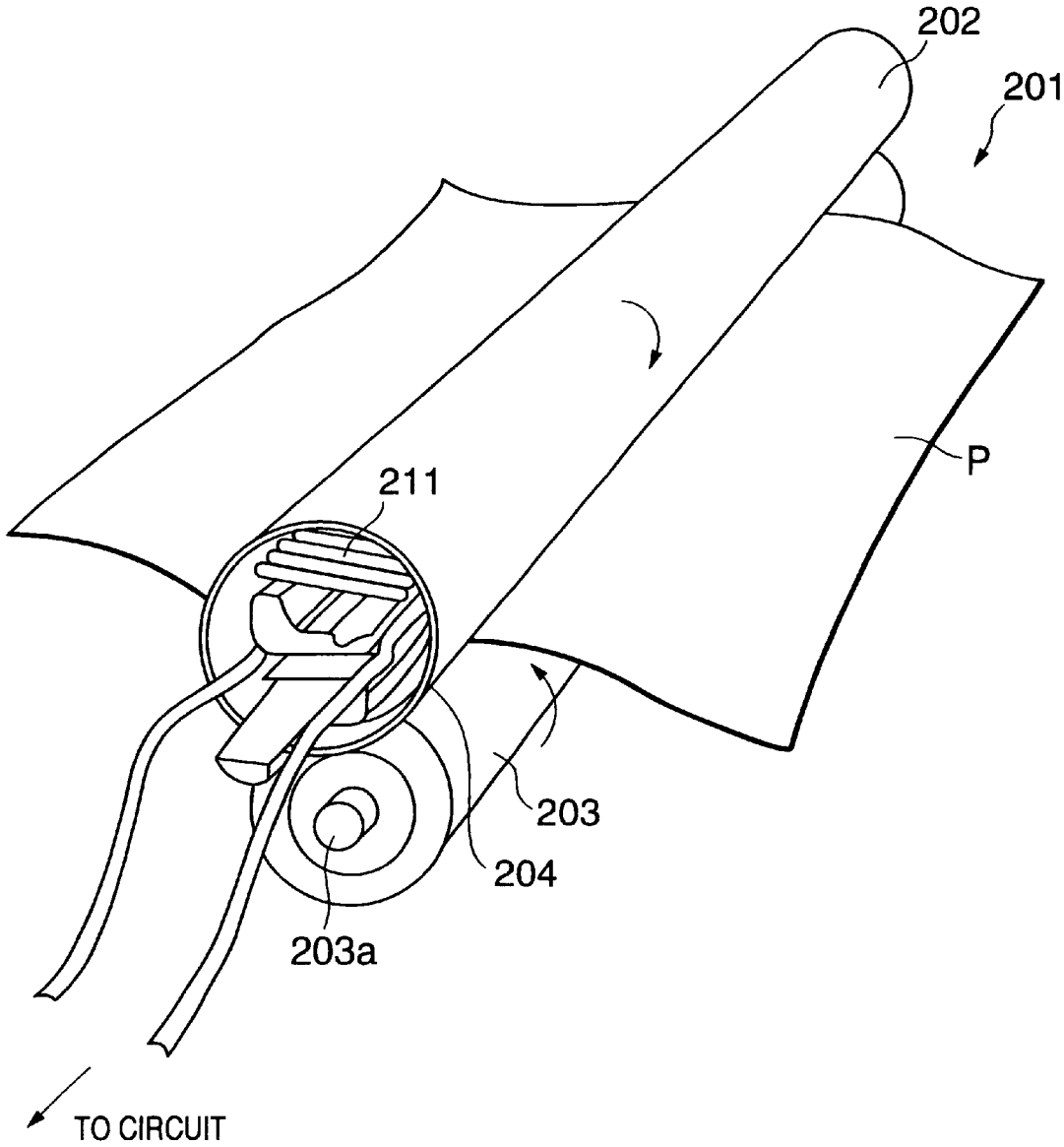
FIG. 27 is a perspective view showing rough shapes of a heat roller and press roller of a fixing device in the image forming apparatus which is related to the present invention.

FIG. 27 shows a schematic structure of a fixing device 201 having an induction heating means as a fixing device in an image forming apparatus that is related to the present invention. The fixing device 201 has a heat roller 202 and press roller 203. The heat roller 202 is driven in the direction of an arrow by a driving motor (not shown). The press roller 203 rotates in the direction of an arrow upon rotation of the heat roller. A print medium P on the surface of which a toner image (not shown) is formed passes between the heat roller 202 and press roller 203.

The heat roller 202 is a cylinder having a thin metal layer (e.g., a thickness=1 mm), and a release layer of Teflon or the like is formed on its surface. In the press roller 203, a coat of an elastic member such as silicone rubber, fluorocarbon rubber, or the like is formed around a core 203*a*. The press roller 203 contacts the heat roller 202 while being applied with a predetermined pressure from a press mechanism (not shown). With this pressure, the outer circumferential surface of the press roller 203 elastically deforms by a predetermined width at the contact position of the heat roller 202 and press roller 203, thus providing a nip 204.

When the print medium P passes through the nip 204, the toner on the print medium P melts, and is fixed under pressure.

The heat roller 202 includes an excitation coil 211 which is made up of a Litz wire as a bundle of a plurality of conductive wires that have a diameter of 0.5 mm and are insulated from each other, and constructs a magnetic field generation means.

The excitation coil 211 generates a magnetic flux upon receiving an RF current from an inverter circuit (not shown), i.e., an excitation circuit. With this magnetic flux, a magnetic flux and eddy current are generated in the heat roller 202 to disturb a change in magnetic field. Joule heat is produced by this eddy current and the intrinsic impedance of the heat roller 202, thus heating the heat roller 202.

The density of magnetic flux generated by the excitation coil 211 is not uniform in the circumferential direction of the heat roller 202 due to the characteristics of the excitation coil 211. The heating temperature of the heat roller 202 depends on the magnetic flux density of the excitation coil 211. Hence, the heating distribution of the heat roller 202 is not uniform.

In this embodiment, maximal heating portions of the heat roller are present at a plurality of positions, and their positions are limited in relation to the position of the press roller, in consideration of the fact that the heat roller using the induction heating means has a nonuniform heating distribution.

Figure 1:
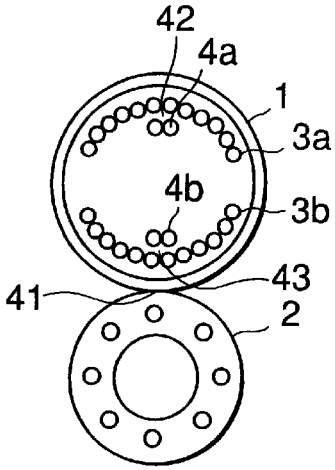
FIG. 1 is a longitudinal sectional view showing the structure of an induction heating fixing device according to the first embodiment of the present invention.

FIG. 1 shows the longitudinal section of a heat roller and press roller as the structure of an induction heating fixing device according to the first embodiment of the present invention. A heat roller 1 is a cylinder having a thin metal layer, and a press roller 2 has a coat of an elastic member on its outer circumferential surface, as described above. At the contact position of the heat roller 1 and press roller 2, the outer circumferential surface of the press roller 2 elastically deforms by a predetermined width to form a nip 41.

The heat roller 1 includes an excitation coil prepared by winding Litz wires 3*a* and 3*b*, and 4*a* and 4*b*. As shown in the longitudinal sectional view of FIG. 1, the Litz wires are wound nonuniformly in the circumferential direction of the heat roller 1, i.e., portions where no Litz wires are present, and portions where double Litz wires are present due to the presence of the Litz wires 4*a* and 4*b* are formed.

Figure 2:
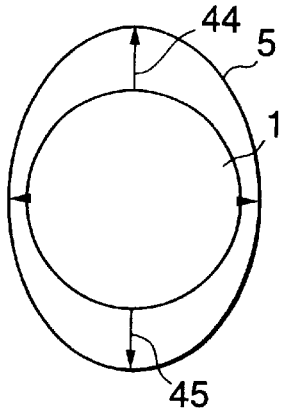
FIG. 2 is a view for explaining the temperature distribution of a heat roller in the induction heating fixing device shown in FIG. 1.

The excitation coil generates a magnetic flux upon receiving an RF current from an excitation circuit, as described above. The portions where the Litz wires 4*a* and 4*b* are present form maximal heating portions 42 and 43 since they have higher magnetic flux density than other portions. FIG. 2 shows a temperature distribution 5 formed around the heat roller 1. As shown in FIG. 2, the temperature distribution 5 has highest temperatures, as indicated by arrows 44 and 45, at the locations of the maximal heating portions 42 and 43.

As a characteristic feature of this embodiment, one (43) of the two maximal heating portions 42 and 43 is located at a position opposing the nip 41 where the heat roller 1 and press roller 2 contact each other. Since the maximal heating portions 42 and 43 are present at two locations, the effect of making the temperature of the heat roller 1 uniform is greater than that obtained by only one maximal heating portion. Furthermore, since the press roller 2 and maximal heating portions 43 are close to each other, the press roller 2 can effectively accumulate heat, and the heat insulation effect improves, thus shortening the warm-up time.

Figure 3:
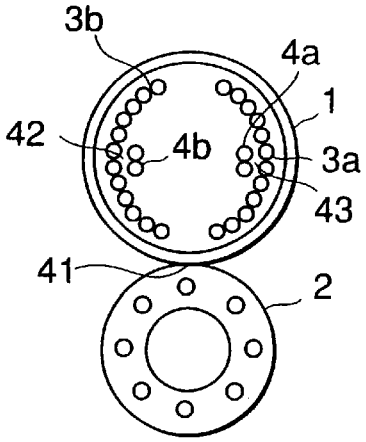
FIG. 3 is a longitudinal sectional view showing the structure when an excitation coil has a phase of 90° with respect to a maximal heating portion.
Figure 4:
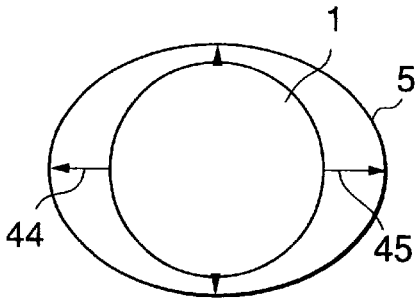
FIG. 4 is an explanatory view showing the temperature distribution of the heat roller in the structure shown in FIG. 3.
Figure 5:
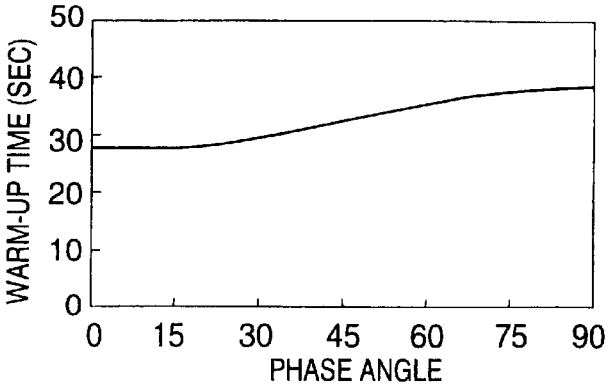
FIG. 5 is a graph showing the relationship between the phase angle of the excitation coil with respect to the maximal heating portion, and the warm-up time.

FIG. 5 shows the relationship between the phase angle of the maximal heating portions 42 and 43 with respect to the nip 41, and the warm-up time. In the embodiment shown in FIG. 2, the phase angle is 0°. In the layout example shown in FIGS. 3 and 4, the maximal heating portions 42 and 43 have a phase angle of 90° with respect to the nip 41.

As can be seen from FIG. 5, the warm-up time is shortest when the phase angle is 0°, and becomes longer as the phase angle approaches 90°. With this graph, the phase angle of the maximal heating portions 42 and 43 with respect to the nip 41 must fall within the range of ±30°, and preferably, the range of ±15°.

In a fixing device according to the second embodiment of the present invention, the location of a temperature sensor for detecting the temperature of the heat roller is limited in addition to the structure of the first embodiment.

Figure 6:
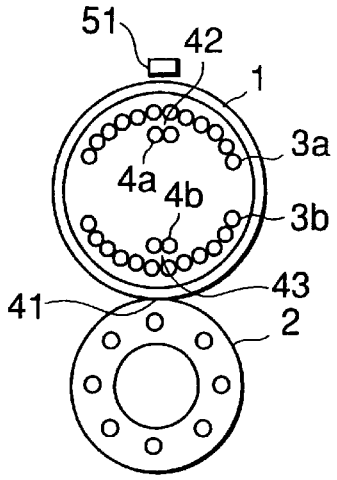
FIG. 6 is a longitudinal sectional view showing the structure of an induction heating fixing device according to the second embodiment of the present invention.
Figure 7:
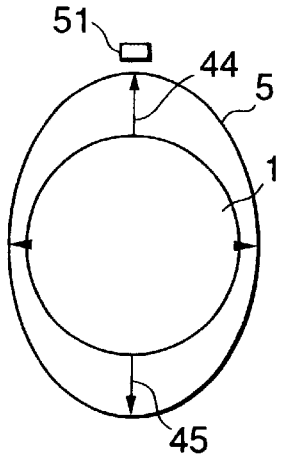
FIG. 7 is an explanatory view showing the temperature distribution of a heat roller in the induction heating fixing device shown in FIG. 6.

As shown in FIG. 6, a temperature sensor 51 is disposed in the vicinity of at least one of the maximal heating portions 42 and 43. In this manner, as shown in FIG. 7, the highest temperature of the maximum heating portion 42 indicated by the arrow 44 in the temperature distribution 5 can be detected. Hence, any excessive overshoot can be prevented, and various abnormalities resulting from overheating can be avoided.

Figure 8:
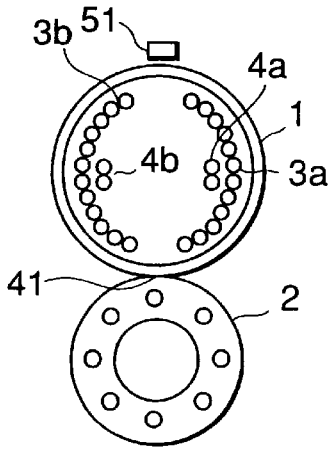
FIG. 8 is a longitudinal sectional view showing the structure when an excitation coil has a phase of 90° with respect to a maximal heating portion.
Figure 9:
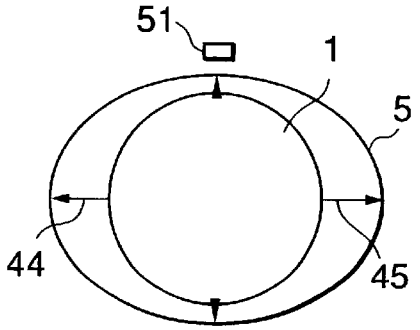
FIG. 9 is an explanatory view showing the temperature distribution of the heat roller in the structure shown in FIG. 8.
Figure 10:
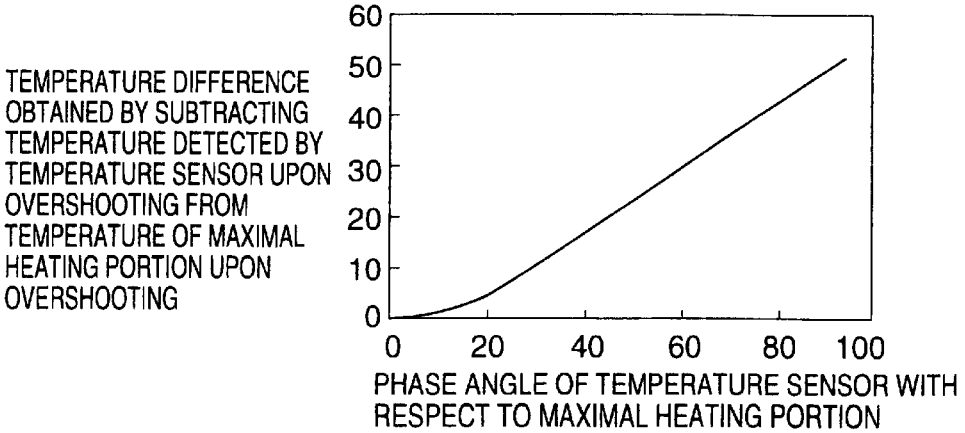
FIG. 10 is a graph showing the relationship between the phase angle of a temperature sensor with respect to the maximal heating portion, and the temperature difference obtained by subtracting the temperature detected by the temperature sensor upon overshooting from the temperature of the maximal heating portion upon overshooting.

FIG. 10 shows the relationship between the phase angle of the temperature sensor 51 with respect to the maximal heating portion, and the temperature difference obtained by subtracting the temperature detected by the temperature sensor 51 upon overshooting from that of the maximal heating portions 42 and 43 upon overshooting. Note that the phase angle of the temperature sensor 51 with respect to the maximal heating portions 42 and 43 is set at 0° when the temperature sensor 51 is located at the position shown in FIG. 6, or at 90° when the temperature sensor 51 is located at the position shown in FIGS. 8 and 9.

As shown in FIG. 10, the temperature difference becomes larger with increasing phase angle. That is, the difference between the temperature detected by the temperature sensor 51 upon overshooting and that of the maximal heating portions 42 and 43 upon overshooting becomes larger with increasing phase angle. For this reason, an excessive overshoot cannot be prevented, and overheating results in operation errors and malfunctions in various mechanisms. This temperature difference must be set at 10° C. or less, and preferably, at 3° C. or less to implement adequate temperature control. As can be seen from FIG. 10, the phase angle must fall within the range of ±30° C. to set the temperature difference at 10° C. or less, or ±15° C. to set the temperature difference at 3° C. or less.

In this embodiment, the temperature sensor 51 is located to fall within the range of ±30°, and preferably, ±15° from the position of at least one of the maximal heating portions 42 and 43.

Figure 11:
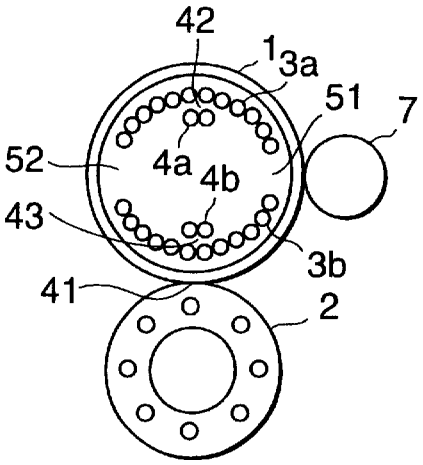
FIG. 11 is a longitudinal sectional view showing the structure of an induction heating fixing device according to the third embodiment of the present invention.

The third embodiment of the present invention comprises a structure in which the position of a release agent applying roller is limited by the relationship with the maximal heating portions in addition to the structure of the first embodiment. FIG. 11 shows the structure of the third embodiment. The release agent applying roller 7 applies a release agent such as silicone oil or the like to the surface of the heat roller 1 to prevent toner from becoming attached to the outer circumferential surface of the heat roller 1. The release agent applying roller 7 uses felt or the like on its surface to be able to be impregnated with silicone oil.

When the temperature of the release agent applying roller 7 becomes too high, the release agent impregnated in the roller flows out too much. As a result, the service life of the release agent applying roller 7 shortens, and the release agent becomes attached to the print medium, thus adversely influencing an image.

In this embodiment, in order to avoid such incidents, the release agent applying roller 7 is placed in the vicinity of one (51) of two minimal heating portions 51 and 52. The minimal heating portions 51 and 52 have a lowest density of magnetic flux generated by the excitation coil. Also, the minimal heating portions 51 and 52 have lowest temperatures as indicated by arrows 53 and 54 in FIG. 12 that shows the temperature distribution. Since the release agent applying roller 7 is located on such portion, any excessive temperature rise can be prevented, thus preventing the service life of the release agent applying roller 7 from shortening, and also preventing the release agent from adversely influencing the image on the print medium.

Figure 12:
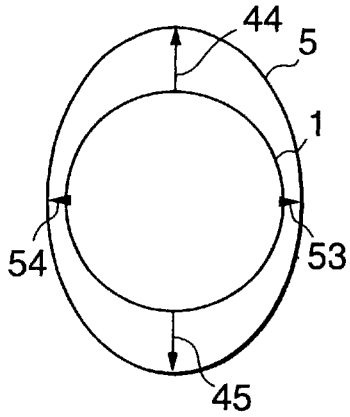
FIG. 12 is an explanatory view showing the temperature distribution of a heat roller in the structure shown in FIG. 11.
Figure 13:
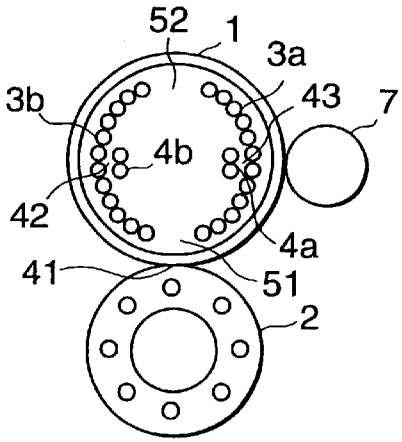
FIG. 13 is a longitudinal sectional view showing the structure when a release agent applying roller is arranged in the vicinity of a maximal heating portion.
Figure 14:
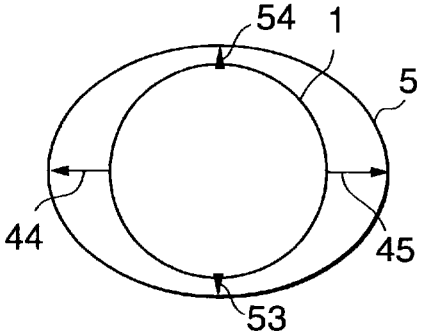
FIG. 14 is an explanatory view showing the temperature distribution of the heat roller in the structure shown in FIG. 13.
Figure 15:
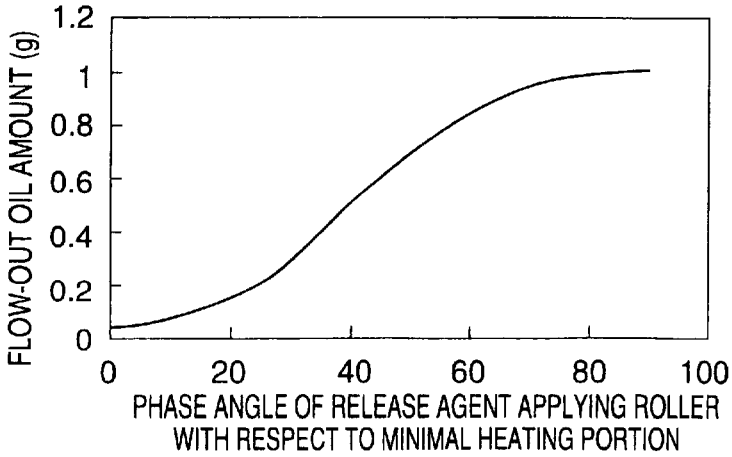
FIG. 15 is a graph showing the relationship between the phase angle of the release agent applying roller with respect to a minimal heating portion, and the flow-out amount of silicone oil.

FIG. 15 shows the relationship between the phase angle of the release agent applying roller 7 with respect to the minimal heating portion 51, and the flow-out amount when silicone oil is used as the release agent. As shown in FIGS. 11 and 12, assume that the phase angle between the minimal heating portion 51 and release agent applying roller 7 when they are closest to each other is 0°. In a layout example shown in FIGS. 13 and 14, the phase angle of the minimal heating portion 51 with respect to the release agent applying roller 7 is 90°. The oil flow-out amount is a total amount of oil that flows out after, for example, one million media to be fixed have undergone the fixing process.

Assume that the oil flow-out amount must be suppressed to, e.g., 0.3 g or less. In this case, as shown in FIG. 15, the phase angle must be 30° or less. Hence, the release agent applying roller 7 must be located in the vicinity of the minimal heating portion 51, i.e., at a position where the phase angle from the minimal heating portion 51 is 30° or less.

Figure 16:
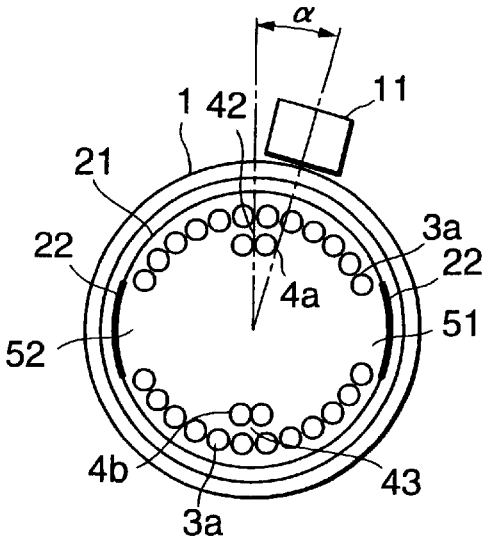
FIG. 16 is a longitudinal sectional view showing the structure of an induction heating fixing device according to the fourth embodiment of the present invention.
Figure 18:
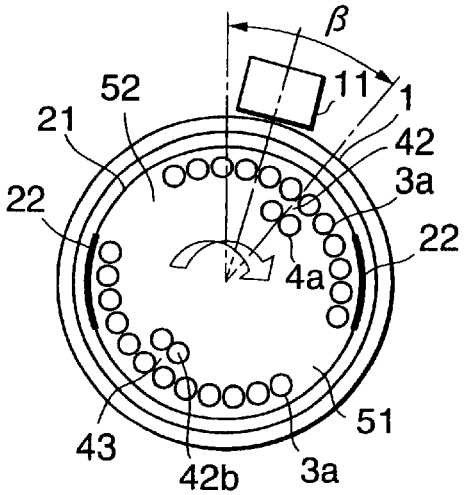
FIG. 18 is a longitudinal sectional view showing the structure when an excitation coil rotates with respect to an insulating sheet in the fourth embodiment.
Figure 20:
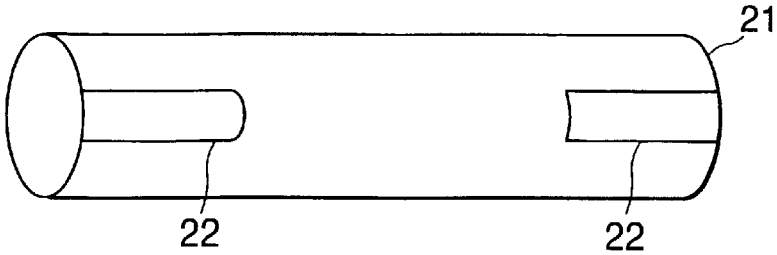
FIG. 20 is a perspective view showing the structure of the insulating sheet in the fourth embodiment.

The fourth embodiment of the present invention comprises a structure for preventing any temperature rise of an end portion of the heat roller 1 when media to be fixed with a small width successively undergo a fixing process, in addition to the structure of the first embodiment, as shown in FIGS. 16, 18, and 20.

An insulating sheet 21 is inserted between the inner circumferential surface of the heat roller 1, and the outer circumferential surface of the excitation coil made up of the Litz wires 3*a* and 3*b*, and 4*a* and 4*b*. The insulating sheet 21 of this embodiment has magnetic flux shielding portions 22 deposited with, e.g. aluminum, at its two end portions, as shown in FIG. 20.

Upon executing the fixing process for a print medium having a normal width, the heating process must be done for the entire surface of the print medium, which extends to the vicinities of the two end portions of the heat roller 1. Hence, as shown in FIG. 16, the magnetic flux shielding portions 22 are located in the vicinity of the minimal heating portions 51 and 52. With this structure, the magnetic flux can be prevented from being shielded by the two end portions of the heat roller 1 and generates heat, and the fixing process can be done. In this case, the magnetic flux density distribution is as shown in FIG. 17, and no magnetic fluxes are present on the minimal heating portions 51 and 52.

However, when media to be fixed having a small width (e.g., A4 width) successively undergo the fixing process, no print medium is present at the two end portions of the heat roller 1 and these roller portions are not deprived of heat. For this reason, heat accumulates at the two end portions of the heat rollers, and the temperatures of these portions become higher than that at the central portion. When a print medium with a large width (e.g., A3 width) undergoes a fixing process while such temperature gradient is present along the longitudinal direction of the heat roller 1, a uniform heating process cannot be achieved, thus generating a defective image suffering, e.g., offset.

Figure 19:
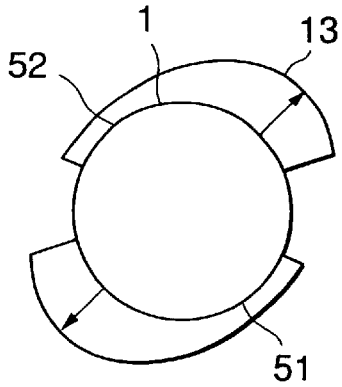
FIG. 19 is an explanatory view showing the distribution of the magnetic flux density in the structure shown in FIG. 18.

For this reason, when media to be fixed with a small width are to be successively processed, the relative positional relationship between the magnetic flux shielding portions 22 and excitation coil is changed by rotating the excitation coil in the direction of an arrow, as shown in FIG. 18, to shield generated magnetic fluxes, i.e., not to heat the heat roller 1. The magnetic flux density distribution in this case is as shown in FIG. 19. In this manner, heat accumulation due to an excessive temperature rise of the two end portions of the heat roller 1 can be prevented. As a result, when media to be fixed with a large width successively undergo the fixing process, the adverse influences on images can be prevented.

Figure 17:
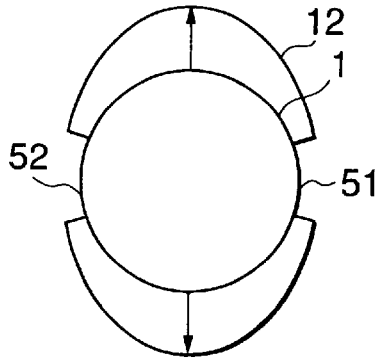
FIG. 17 is an explanatory view showing the distribution of the magnetic flux density in the structure shown in FIG. 16.

A temperature sensor 11 for detecting the temperature of the heat roller 1 is preferably located at a position where a is substantially equal to $\beta/2$ where $\alpha$ is the phase angle with respect to the maximal heating portion 42, as shown in FIG. 16, and $\beta$ is the rotation angle when the excitation coil has been rotated in the direction of the arrow from FIG. 16 to FIG. 18. With this layout, normal control can be done by detecting the temperature of the heat roller 1 without being seriously influenced by the position of the excitation coil.

The fifth embodiment of the present invention comprises a structure in which the thickness of an iron layer of the heat roller 1 is limited to prevent temperature rises at the two end portions of the heat roller 1, in addition to the structure of the first embodiment.

Figure 21:
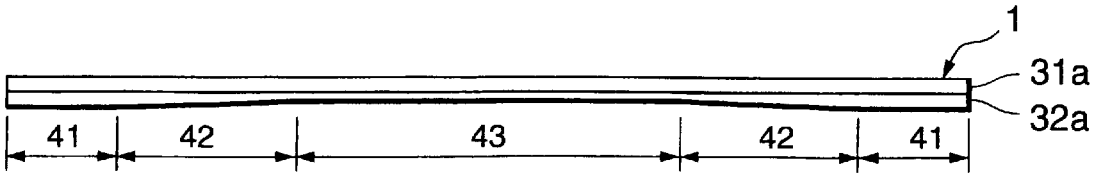
FIG. 21 is a longitudinal sectional view showing the longitudinal section of a heat roller in an induction heating fixing device according to the fifth embodiment of the present invention.

The heat roller generally has a two-layered structure of an iron layer and aluminum layer. In this embodiment, as shown in FIG. 21 that shows a longitudinal section of the heat roller 1, an aluminum layer 31*a* has a constant thickness. A central portion 43 of an iron layer 32*a* has a constant thickness, two end portions 41 have a thickness larger than that of the central portion 43, and the thickness of regions 42 between the central portion 43 and the two end portions 41 gradually increases from the center toward the two end portions.

Figure 23:
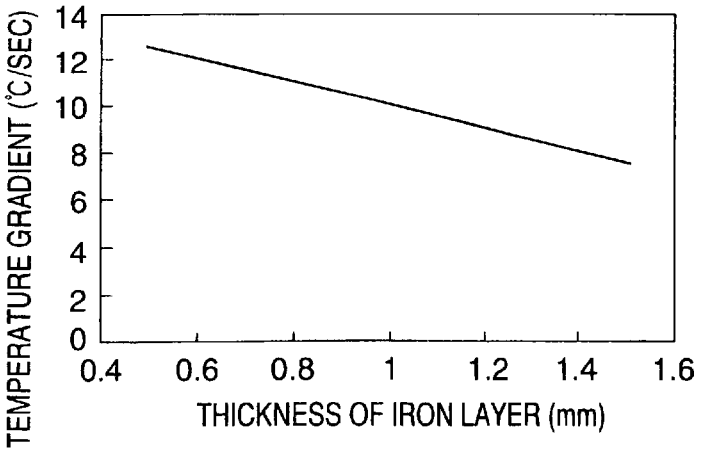
FIG. 23 is a graph showing the relationship between the thickness of an iron layer and a change in temperature per unit time.

Iron has lower thermal conductivity than aluminum. Hence, as shown in FIG. 23, temperature rise per unit time becomes smaller with increasing thickness of the iron layer. Hence, since temperature rises at the two end portions 41 where the iron layer has larger thickness become smaller than at the central portion 43, such temperature rises at the two end portions 41 can be suppressed.

Figure 22:
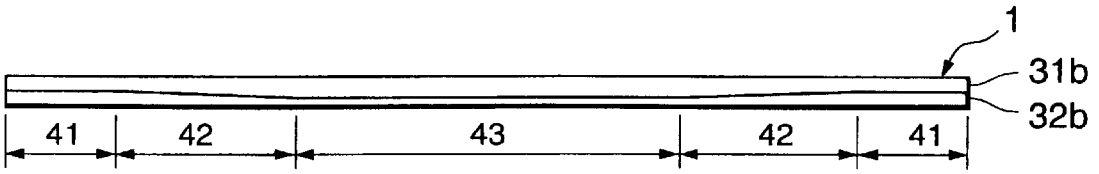
FIG. 22 is a longitudinal sectional view showing the longitudinal section of another heat roller in the induction heating fixing device of the fifth embodiment.

In the structure shown in FIG. 21, the thickness of the aluminum layer 31*a* is constant, and that of the iron layer 32*a* changes. By contrast, in a structure shown in FIG. 22, the total thickness of an iron layer 31*b* and aluminum layer 32*b* is uniform at all of the central portion 43, two end portions 41, and regions 42 therebetween. The aluminum layer 31*b* has a large thickness at the central portion 43 and a small thickness at the two end portions 41, and the thickness decreases from the center to the two end portions in the regions 42. As a result, relatively, the iron layer 32*b* has a smallest thickness at the central portion 43 and a large thickness at the two end portions 41, and the thickness increases from the center toward the two end portions in the region 42. With this structure, temperature rises at the two end portions can be suppressed as in the structure shown in FIG. 21.

The sixth embodiment of the present invention comprises a structure for preventing thermal fatigue of the heat roller 1 by changing the stop position of the heat roller 1, in addition to the structure of the first embodiment.

The excitation coil has a plurality of maximal and minimal heating portions, as described above. For this reason, the heat roller 1 is heated nonuniformly. As a result, when the heat roller 1 is stopped, the maximum temperature difference is, e.g., 80° C., and the heat roller 1 deforms to have an elliptic section resulting from nonuniform thermal expansion.

Furthermore, nonuniform stress acts on bearing inner rings which are placed at the end portions of the heat roller 1, resulting in wear of bearings.

Figure 25:
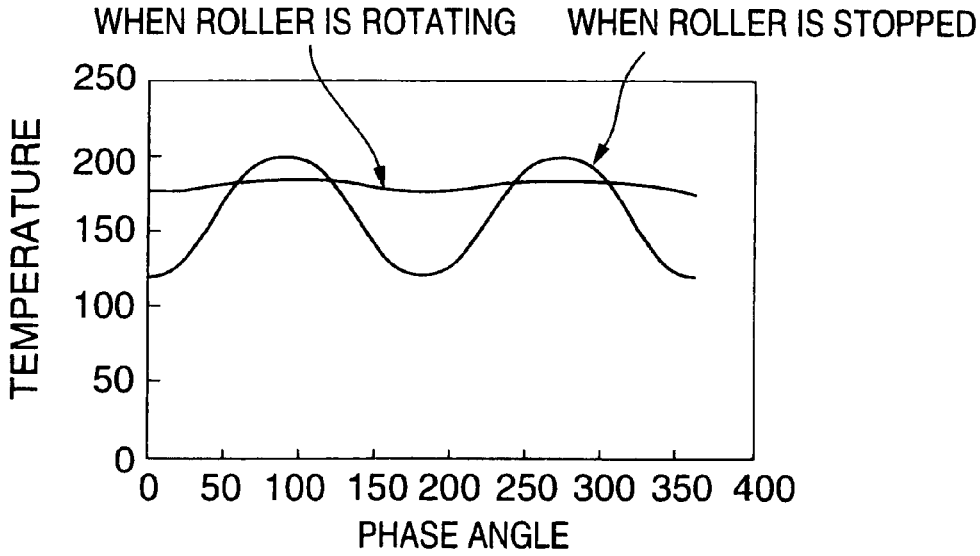
FIG. 25 is a graph showing the temperature difference upon rotating and stopping a heat roller.
Figure 26:
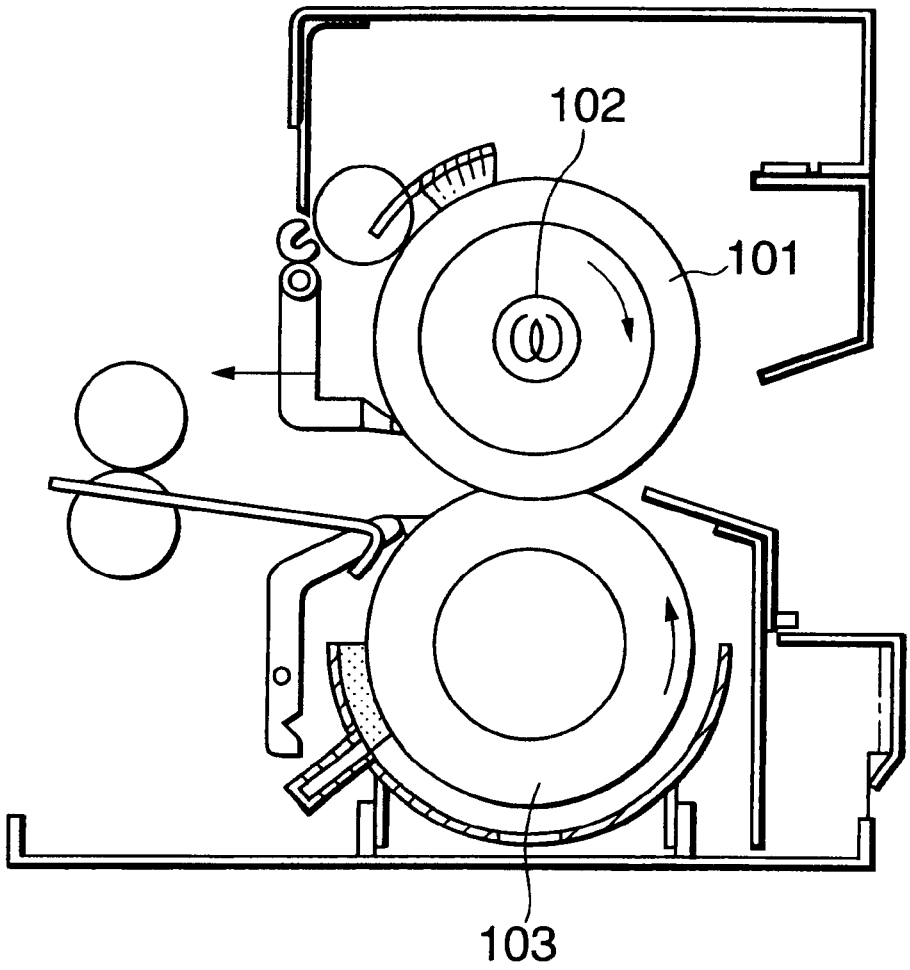
FIG. 26 is a longitudinal sectional view showing a schematic structure of an image forming apparatus which is related to the present invention.

On the other hand, when the heat roller 1 is rotating, a nearly uniform temperature distribution is obtained, as shown in FIG. 25.

For this reason, in order to make the heating distribution uniform when the heat roller 1 is stopped, the stop position of the heat roller 1 relative to the excitation coil is changed every time it is stopped, so that portions which are heated to the highest temperature by the maximal heating portions change every time the roller 1 is stopped. As a result, specific portions of the heat roller 1 can be prevented from being heated for a long period of time while the heat roller 1 is stopped.

Figure 24:
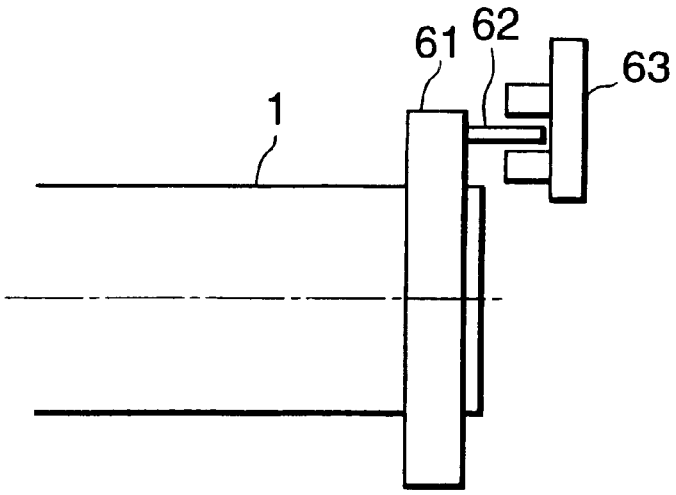
FIG. 24 is a longitudinal sectional view showing the structure of an induction heating fixing device according to the sixth embodiment of the present invention.

As an example of a mechanism, as shown in FIG. 24, a projecting detection member 62 is formed on that portion of a gear 61, which is provided as a rotation mechanism. When a sensor 63 detects the presence of the detection member 62, the stop position of the heat roller 1 is controlled to change every time the heat roller 1 is stopped.

The aforementioned embodiments are merely examples and do not limit the present invention. For example, in the above embodiment, two maximal heating portions are present in the circumferential direction of the heat roller. However, three or more maximal heating portions may be present. When three or more maximal heating portions are present, the effect of making the heat roller temperature uniform can be improved. In this case, at least one of these maximal heating portions can be located within the range of ±30°, and preferably, ±15°, from the nip position facing the press roller.

The temperature sensor in the second embodiment is not particularly limited. For example, a thermistor, temperature fuse, thermostat, or the like may be used.

Furthermore, the iron layer and aluminum layer in the fifth embodiment can be a first metal layer with low thermal conductivity, and a second metal layer with relatively high thermal conductivity, and they can be formed using other metals.

What is claimed:

1. An induction heating fixing device for an image forming apparatus, comprising:

a hollow heat roller, a surface of which has a coat of a metal layer, induction heating means, arranged in said heat roller, for generating a magnetic flux in said heat roller to heat said heat roller by induction;

a press roller which is in contact with said heat roller under a predetermined pressure, and wherein said induction heating means has at least two maximal heating portions in a circumferential direction of said heat roller;

a release agent applying roller for applying a release agent onto an outer circumferential surface of said heat roller, and wherein said induction heating means has at least one minimal heating portion in the circumferential direction of said heat roller, and said release agent applying roller is located to fall within a range of ±30° along the circumferential direction from a position of the minimal heating portion.

2. An induction heating fixing device for an image forming apparatus, comprising:

a hollow heat roller, a surface of which has a coat of a metal layer;

induction heating means, arranged in said heat roller, for generating a magnetic flux in said heat roller to heat said heat roller by induction;

a press roller which is in contact with said heat roller under a predetermined pressure, and wherein said induction heating means has at least two maximal heating portions in a circumferential direction of said heat roller;

a temperature sensor for detecting a temperature of said heat roller , and wherein said temperature sensor is located to fall within a range of ±30° along the circumferential direction from the position of at least one of the maximal heating portions;

a release agent applying roller for applying a release agent onto an outer circumferential surface of said heat roller, and wherein said induction heating means has at least one minimal heating portion in the circumferential direction of said heat roller, and said release agent applying roller is located to fall within a range of ±30° along the circumferential direction from a position of the minimal heating portion.

3. An induction heating fixing device for an image forming apparatus, comprising:

a hollow heat roller, a surface of which has a coat of a metal layer;

induction heating means, arranged in said heat roller, for generating a magnetic flux in said heat roller to heat said heat roller by induction;

a press roller which is in contact with said heat roller under a predetermined pressure, and wherein said induction heating means has at least two maximal heating portions in a circumferential direction of said heat roller;

a temperature sensor for detecting a temperature of said heat roller, and wherein said temperature sensor is located to fall within a range of ±30° along the circumferential direction from the position of at least one of the maximal heating portions;

a drive mechanism for rotating said heat roller, and wherein said drive mechanism drives said heat roller to vary a stop position with respect to the maximal heating portions of said induction heating means every tome said heat roller is stopped.

4. An induction heating fixing device for an image forming apparatus, comprising:

a hollow heat roller, a surface of which has a coat of a metal layer;

induction heating means, arranged in said heat roller, for generating a magnetic flux in said heat roller to heat said heat roller by induction; and a press roller which is in contact with said heat roller under a predetermined pressure, wherein said heat roller includes, as the metal layer, at least a first metal layer having first thermal conductivity, and a second metal layer having second thermal conductivity higher than the first thermal conductivity, and a thickness of the first metal layer in a radial direction of said heat roller is larger at end portions of said heat roller in a longitudinal direction than at a central portion in the longitudinal direction.

5. A device according to claim 4, wherein the thickness of the second metal layer in the radial direction of said heat roller is constant from two end portions of said heat roller in the longitudinal direction to the central portion thereof in the longitudinal direction.

6. A device according to claim 4, wherein the thickness of the second metal layer in the radial direction of said heat roller is larger at end portions of said heat roller in the longitudinal direction than at the central portion thereof in the longitudinal direction.

7. A device according to claim 4, wherein a total thickness of the first and second metal layers in the radial direction of said heat roller is constant over the longitudinal direction of said heat roller.

8. An induction heating fixing device for an image forming apparatus, comprising:

a hollow heat roller, a surface of which has a coat of a metal layer;

induction heating means, which is arranged in said heat roller and has an excitation coil, for generating a magnetic flux in said heat roller by supplying a current to the excitation coil to heat said heat roller by induction; and a press roller which is in contact with said heat roller under a predetermined pressure, wherein an insulating sheet is inserted between an inner surface of said heat roller and the excitation coil, and the insulating sheet has magnetic flux shielding portions for shielding the magnetic flux generated by the excitation coil for two end portion regions of said heat roller in a longitudinal direction.

9. A device according to claim 8, further comprising a rotation mechanism for rotating the excitation coil relative to the insulating sheet, and wherein said rotation mechanism rotates the excitation coil to locate the magnetic flux shielding portions in the vicinity of portions where a density of magnetic flux generated by the excitation coil has a first value, when a print medium having a first width undergoes a fixing process, and to locate the magnetic flux shielding portions in the vicinity of portions where the density of magnetic flux generated by the excitation coil has a second value higher than the first value, when a print medium having a second width smaller than the first width undergoes the fixing process.

10. A device according to claim 8, further comprising a rotation mechanism for rotating the excitation coil relative to the insulating sheet, and wherein said rotation mechanism rotates the excitation coil to locate the magnetic flux shielding portions in the vicinity of portions where a density of magnetic flux generated by the excitation coil has a first value, when a print medium having a first width undergoes a fixing process, and to locate the magnetic flux shielding portions in the vicinity of portions where the density of magnetic flux generated by the excitation coil has a second value higher than the first value, when a print medium having a second width smaller than the first width undergoes the fixing process, and a temperature sensor is located at a position which has a phase angle $\alpha$ with respect to a position of one of maximal heating portions along the circumferential direction, and in which $\alpha$ is substantially equal to $\beta/2$ where $\beta$ is the maximum rotation angle of the excitation coil.

* * * * *